United States Patent [19]

Mongan

[11] 4,059,931

[45] Nov. 29, 1977

[54] BUILDING FRAMING SYSTEM FOR POST-TENSIONED MODULAR BUILDING STRUCTURES

[76] Inventor: William T. Mongan, Box 69, R.D. No. 2, Factoryville, Pa. 18419

[21] Appl. No.: 653,398

[22] Filed: Jan. 29, 1976

[51] Int. Cl.[2] ..... E04B 1/348; E04C 3/10

[52] U.S. Cl. ..... 52/79.12; 52/227; 52/230

[58] Field of Search ..... 52/227, 637, 236, 223 R, 52/228, 294, 230, 296, 73, 126, 745, 79, 747; 24/122.6

[56] References Cited

U.S. PATENT DOCUMENTS

| | | | |
|---|---|---|---|
| 3,081,976 | 3/1963 | Carlson et al. | 52/223 R X |
| 3,087,206 | 4/1963 | Delf et al. | 52/126 |
| 3,152,421 | 10/1964 | Middendorf | 52/227 |
| 3,226,894 | 1/1966 | Burchardt et al. | 52/227 X |
| 3,403,492 | 10/1968 | Spencer | 52/230 X |
| 3,405,490 | 10/1968 | Marr | 52/230 X |
| 3,427,772 | 2/1969 | Williams | 24/122.6 |
| 3,466,823 | 9/1969 | Dowling | 52/227 |
| 3,524,228 | 8/1970 | Kelly | 52/230 X |
| 3,541,744 | 11/1970 | Maxwell | 52/73 |
| 3,562,979 | 2/1971 | Ali-Oglu | 52/236 X |
| 3,613,325 | 10/1971 | Yee | 52/236 |
| 3,744,200 | 7/1973 | Rice | 52/227 |
| 3,785,097 | 1/1974 | Seymour | 52/227 X |
| 3,795,949 | 3/1974 | Shorter | 52/223 R X |
| 3,823,520 | 7/1974 | Ohta et al. | 52/236 X |
| 3,846,946 | 11/1974 | Sandstrom et al. | 52/221 |

FOREIGN PATENT DOCUMENTS

| | | | |
|---|---|---|---|
| 90,167 | 9/1967 | France | 52/228 |
| 2,207,955 | 8/1973 | Germany | 52/79 |
| 1,066,525 | 4/1967 | United Kingdom | 52/126 |

*Primary Examiner*—Leslie Braun
*Attorney, Agent, or Firm*—Sidney W. Russell

[57] ABSTRACT

An assembly of structural elements capable of disassembly, capable of addition horizontally and vertically, capable of reduction in size horizontally and vertically, the entire structure accomplishing such purposes and objectives by the use of precast concrete elements, precast with wire tensioning bores therethrough, so that upon assembly of such elements the assembly can be post-tensioned in place; also being subject to ready disassembly or reduction in size by removal of individual elements by facile release of the tension wires. The entire assembly thus represents a composite of basic individual structural elements, which when attached together form the basic system of the complete building unit, are capable of receiving habitable precast modules or capable also of utilization in the formation of basic floor framing systems.

5 Claims, 27 Drawing Figures

FIG. 5
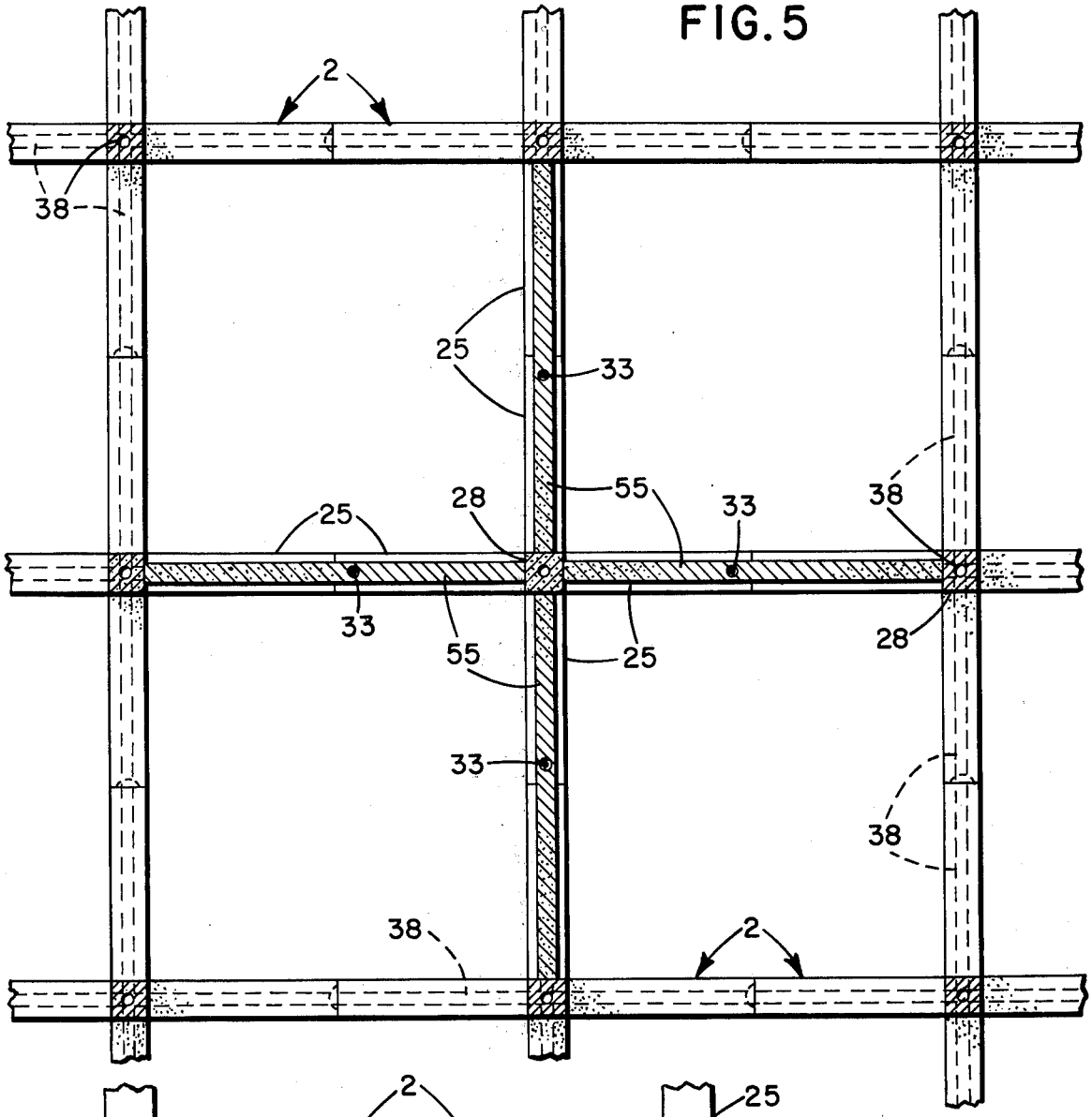
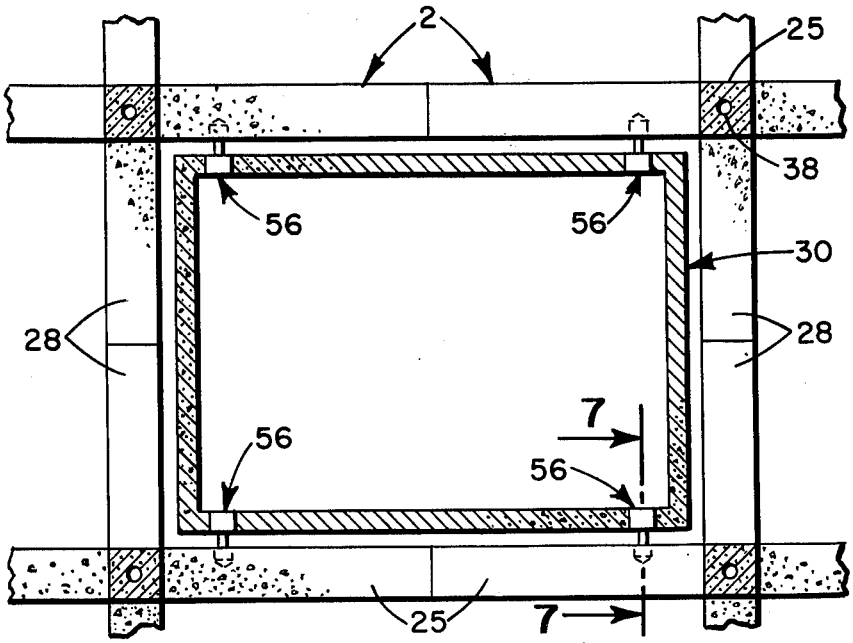
FIG. 6

BUILDING FRAMING SYSTEM FOR POST-TENSIONED MODULAR BUILDING STRUCTURES

BACKGROUND OF THE INVENTION AND PRIOR ART

As indicated in the foregoing Abstract, the system and method of this invention utilizes individual components of relatively small and transportable size which, when post-tensioned together in multiples form a prefabricated framing system. Although such components are tied together with tensioning wires, an important facet of my system is that the column or support spacing can be varied as required to meet building design considerations. Also, the system permits the addition or deletion of these basic components in any existing framework, this being an important consideration in many types of building structures such as, for example, hospitals and manufacturing plants. The latter are frequently subjected to changes in size and function and in the use of the instant novel scheme such is made possible. The individual components which are utilized in multiples for any building framework consist of a pair of horizontal intersecting beams cast integrally with a vertical column passing through the point of intersection of the horizontal beams; thus the components have four horizontal legs and two legs extending on each side vertically therefrom. In an alternate form, there may be four legs to the basic structure, positioned horizontally, and one extending leg positioned vertically thereto either downwardly therefrom or upwardly therefrom, thus comprising what might be termed a five-leg arrangement. These basic components form the basic structure of the ultimate building when tensioned and secured together in the manner hereinafter set forth. These individual elements are of reasonable size, i.e., such to meet the maximum load width of 12 feed which is generally imposed in most areas. Such limits the size of these components to about 16 feet along any axis, but meeting the 12 feet limit assuming the component is set on the transporter in a position where two of the legs thereof are angled to the horizontal. Despite this size limitation, when such basic components are utilized in forming the framing system of a given building, they are fully adequate for the erection of a framing system of a building of almost any reasonable size configuration.

There have been many attempts in the past to devise individual building components in an effort to achieve a pre-assembly in a building system representing the framework thereof. There have also been developments wherein both pre-tensioning and post-tensioning means have been utilized in this regard. However, the pre-tensioning media are not akin to this invention, simply because this improvement represents a scheme of post-tensioning media. Moreover, such post-tensioning systems as heretofore developed do not utilize the same method or means of achieving post-tensioning. In my system, when these elements are utilized in multiples they are first initially placed in position and held in such position by temporary restraining means. Concerning each leg of each structural element, the same is provided with an axial bore therethrough, this to accommodate a post-tensioning wire or wires therethrough and through adjacent members of the same type of structural element. Once wires are passed through each series of legs through the said bores, then the wires are tensioned by means to be later described, to thus stabilize and maintain the entire structure in permanent fashion.

Although certain prior art might approach resemblance to the individual structural elements which are herein utilized, the system and method of utilization is different and with no thought of a post-tensioning arrangement whereby, for example, a full room size framing of a given building, or multiples thereof, can be added or subtracted with regard to the completed building framework.

For example, the Dowling U.S. Pat. No. 3,466,823 utilizes a so-called tri-axial interlocking building element. These are interconnected via a non-rigid connector for interlocking the same together. The system of Dowling does not contemplate nor approach the novel scheme herein presented of elimination of such an interlock and of reliance entirely upon post-tensioned wires extending through the adjacent arms of a series of similar elements thus to sustain the entire load by post-tensioning means. Furthermore, a primary drawback of the Dowling system resides in the limitation in size of such components if they are to be transported over roadways to the construction site. Also, in the Dowling system, and as indicated, not only are welded connections and shim plates employed (at best an awkward procedure for assembly of the elements) but no means is provided for eliminating deflections in a cantilever, especially if one is added to the framing. The instant invention includes a means of controlling such deflection, and further, provides for the flexibility of this framing system relative to span variations. Although the said prior art item indicates the possible use of concrete as a material for the disclosed components, the reference indicated by that disclosure is primarily for the use of steel, aluminum, etc. — indicating the necessity of fireproofing of such an assembly. It should also be noted that systems such as these do not permit framing variations, as in the instant invention, utilizing the structural elements which I employ. This means that such arrangements as in the system of the referred to patent could accommodate only about a 16 foot maximum column spacing in the building.

Other prior art is equally irrelevant: the Sardstrom et al. U.S. Pat. No. 3,846,946 illustrates the system of horizontal and vertical precast slabs or panels welded together at their juncture. In situ, concrete covers the welded joint. That system is thus also totally dissimilar. In Van Bijlevelt U.S. Pat. No. 3,295,266, the disclosed system is such that the resultant floor arrangement is made up of beams and slabs whereas in the instant case the floor and roof framing system comprises a two-way truss with integrally placed concrete floor slabs. Also, as to the latter patent, the beams and slabs are raised separately and assembled at respective floor levels whereas in my development the floor framing system, with integral floor slabs, can be raised as an entity.

Although Middendorf U.S. Pat. Nos. 3,029,490 and 3,270,471 appear to cover basic principles in post-tensioning an horizontally concrete member as a beam or slab, the involved tension members serve to limit deflection in the beam — the greater the load on the beam the more tension must be exerted to limit deflection. In contrast, in my floor framing system comprising a two-way truss made up of structural elements, the bottom and top horizontal cords of the truss are held in compression through the action of the tensioning wires therein. The wires are in axial alignment with the cord members of the truss form and do not serve to prevent deflection of these members. Rather, the tension wires serve to hold together the components of the truss system, and also serve to prevent deflection or sagging of same.

The Middendorf (U.S. Pat. No. 3,255,558) and Dietrich (U.S. Pat. No. 3,696,574) patents are of a related nature to the other prior art mentioned above and involve fastening system not equivalent to my post-tensioned arrangement.

The system of this invention is thus presented as an entirely novel system, means and method unique to the prior art for prefabrication of structural elements, transportation to the site, erection at the site and after temporary stabilizing and securing in position, post-tensioning of the entire assembly to achieve a permanent building framing; also, with such an assembled structure, even when completed as filled with modular units to be inserted therein, the same is subject to enlargement or reduction in size, room by room or in multiples of rooms.

OBJECTS AND ADVANTAGES OF THE INVENTION

The primary objective of my invention is thus to provide a system and method of building utilizing a minimum variety of components or structural elements which, when assembled, provide a structural system adaptable to a wide variety of building types; i.e., hotel or motel structures, apartments, office buildings, hospitals, factories and manufacturing facilities, and so on.

Another object of the invention is to provide a system with substantial inherent advantages over conventional structural systems and prefabricated systems now in use wherein the complete framing is accomplished by a minimum variety of structural elements — an inherent and fundamental advantage.

A further objective of the invention is to provide a building system which is capable of rapid assembly and/or disassembly, to thus permit increase or reduction in size, either horizontally or vertically. In this regard, the system of this invention, and primarily floor framing system, is capable of variations in span between supports, which also can be cantilevered. Deflections in the system are limited or eliminated by the post-tensioning of the wires in assembling the structural elements comprising the over-all assembly.

Another objective of my invention is to provide a building system which is particularly capable of receiving a plurality of habitable modules yet requires only individual units which, because of their relatively small dimension, can be readily transported to the site. Such method of construction is also suitable for the support of roadways or pedestrian ways which might be incorporated into a complex of buildings comprised of these structural elements.

Finally, it is a further object of my invention to provide a system and method for fabrication of buildings which renders feasible the construction of complete urban complexes utilizing only this system of building; to my knowledge, no other prefabricated building system offers this capability and particularly the capability of being flexible, that is, permitting use in a wide variety of building types, yet requiring few variations in the primary structural elements comprising the basic components of the system.

DETAILED DESCRIPTION OF THE INVENTION

The invention can be more clearly understood by reference to the accompanying drawings, wherein:

FIG. 5 is a section view taken on the line 5—5 of FIG. 4 illustrating the use of vertical concrete wall panels to stabilize a given portion of the entire building structure, that is, means to establish plumb and level throughout the entire building structure.

FIG. 6 is a vertical section view through a portion of a building particularly illustrating the means for support of a preformed concrete, enclosed structure adapted to occupy one of the modular spaces within the building framework;

Figure 3:
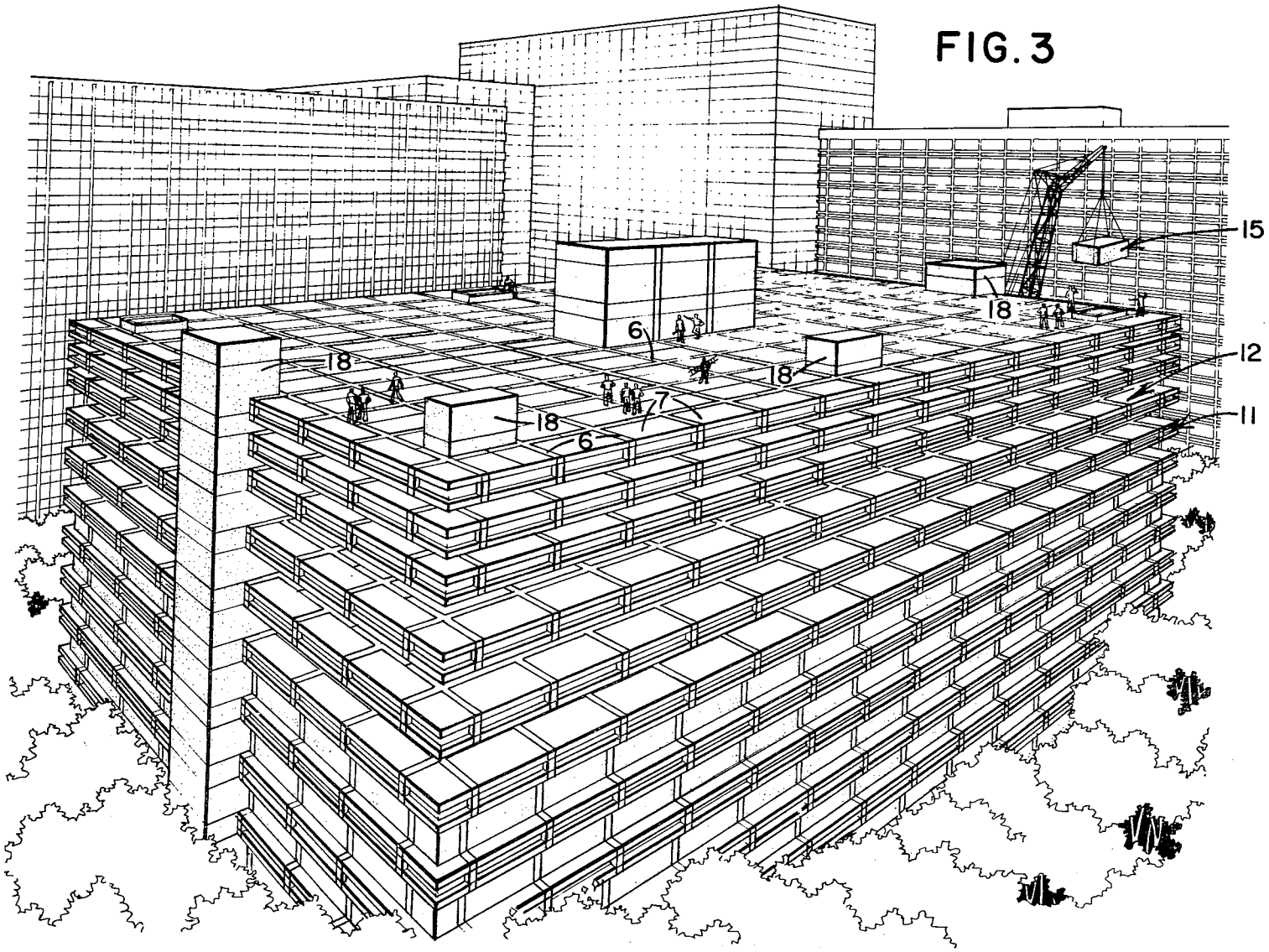
FIG. 3 is another perspective view graphically illustrating my system of erecting a building wherein all floors thereof are preassembled on the ground and sequentially jacked or raised into place and as shown more diagrammatically in FIGS. 15 and 16 herein.
Figure 4:
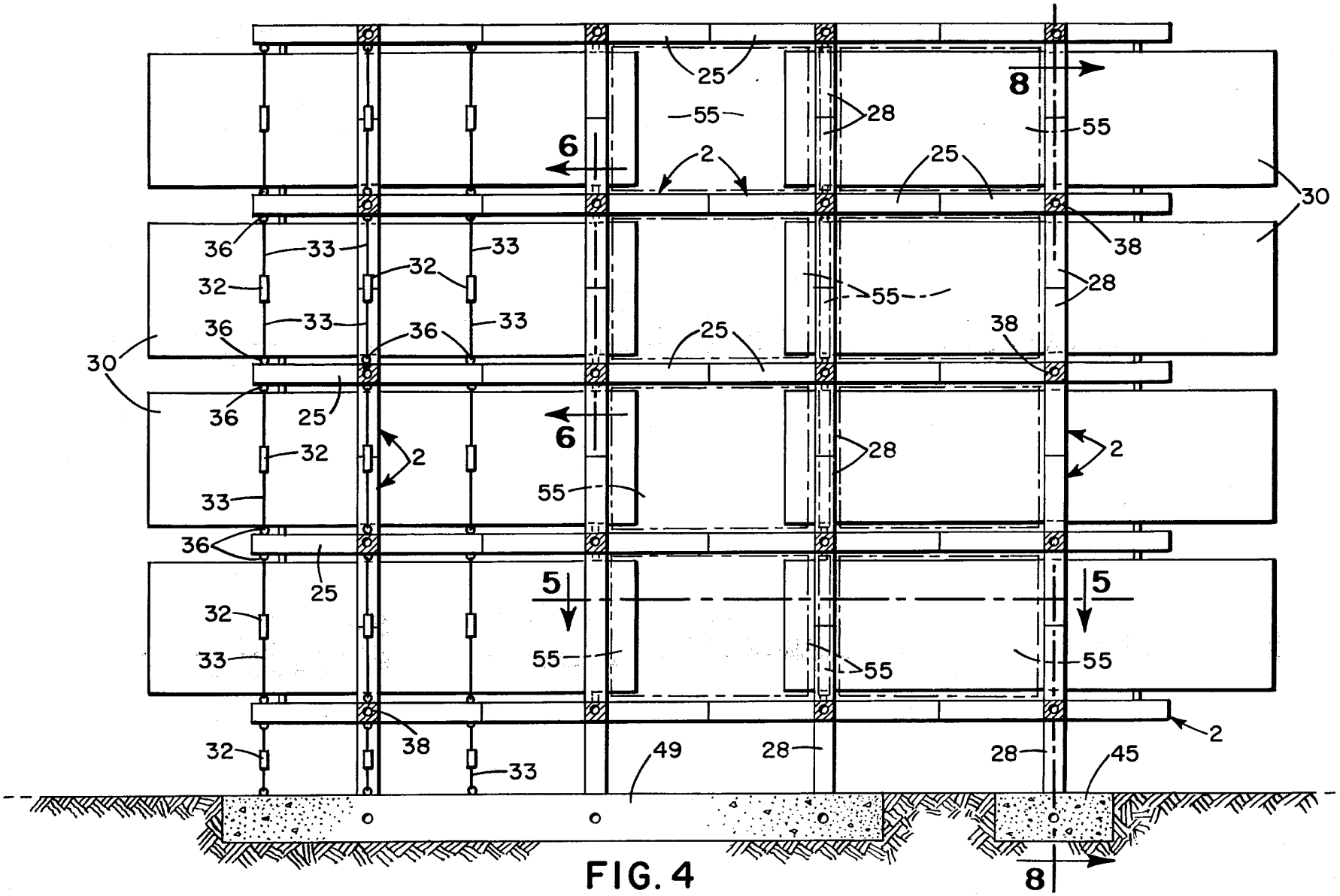
FIG. 4 is a vertical section view of a portion of a building constructed using my basic structural elements which, used in multiples, form horizontal beams and vertical columns to provide a framework for the insertion of prefabricated enclosed structures, i.e., this Figure illustrates inclusion of such prefabricated structures.
Figure 13:
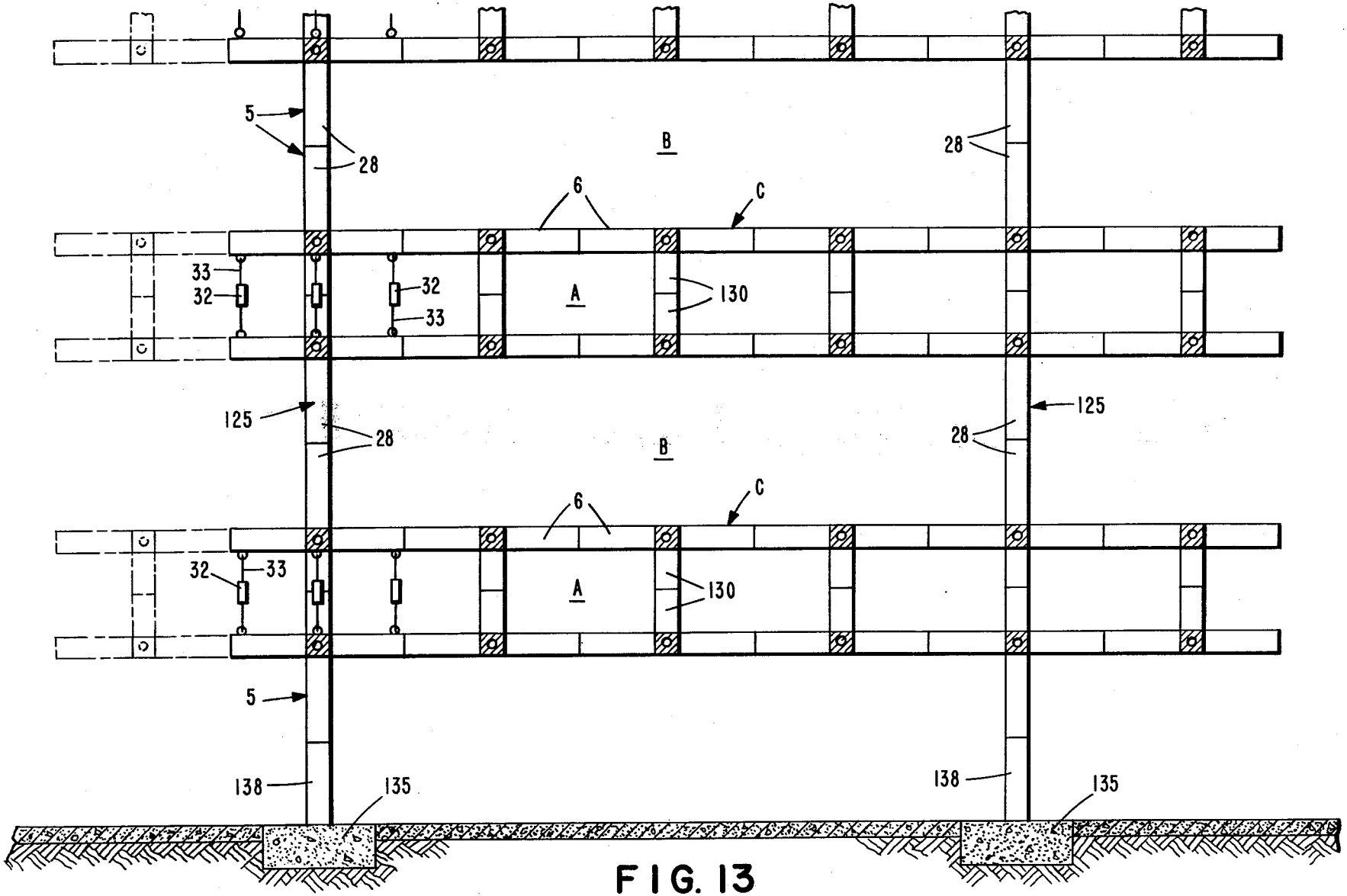
FIG. 13 represents a vertical section view, diagrammtic in form, of a building constructed of the framing elements utilized to form that type of building as same is illustrated in FIG. 2.
Figure 14:
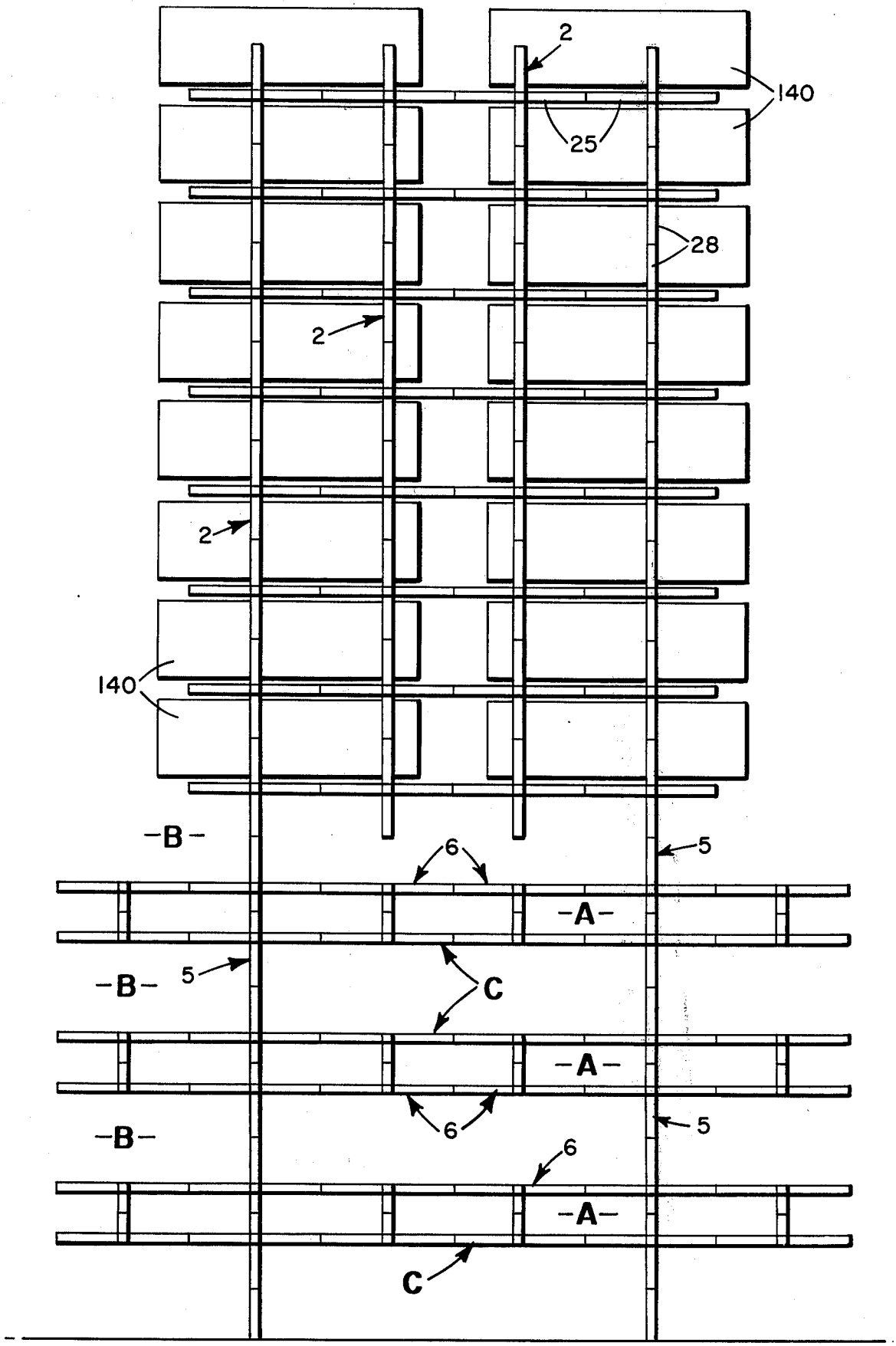
Figure 16:
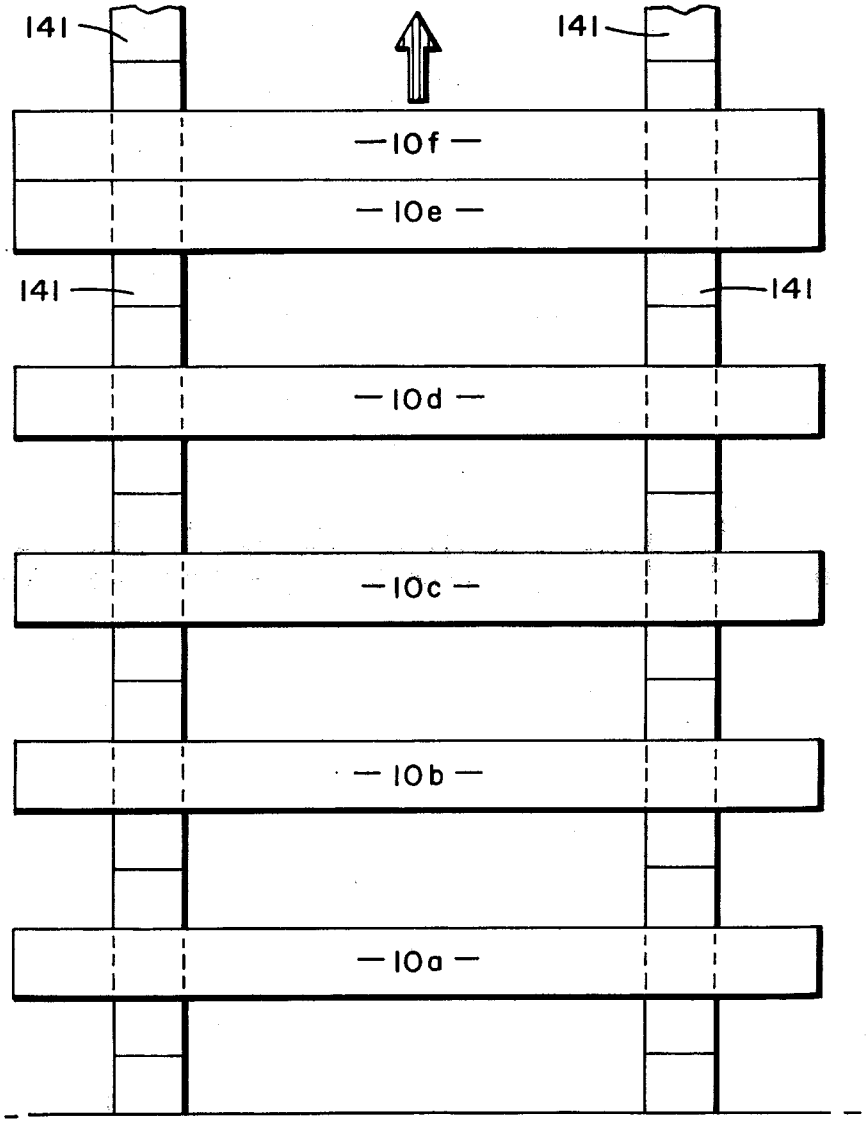
Figure 15:
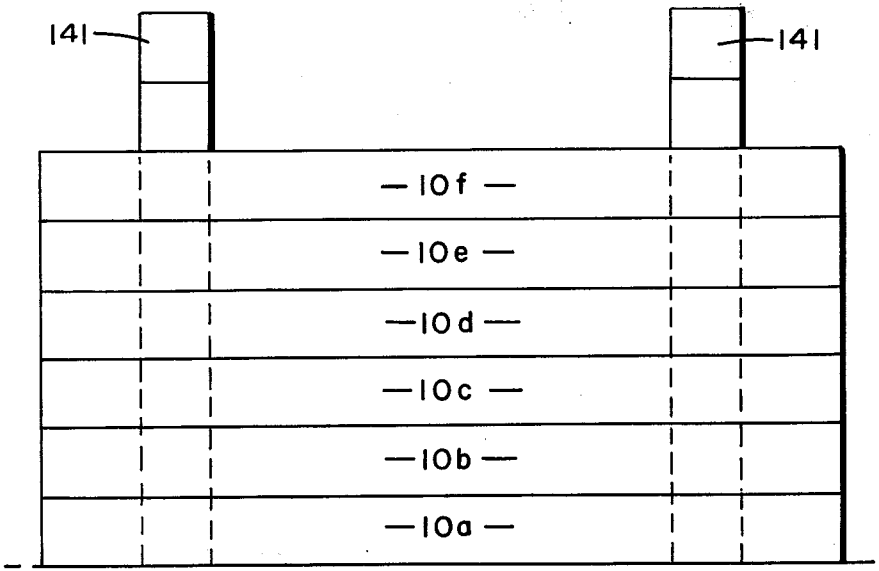
Figure 17:
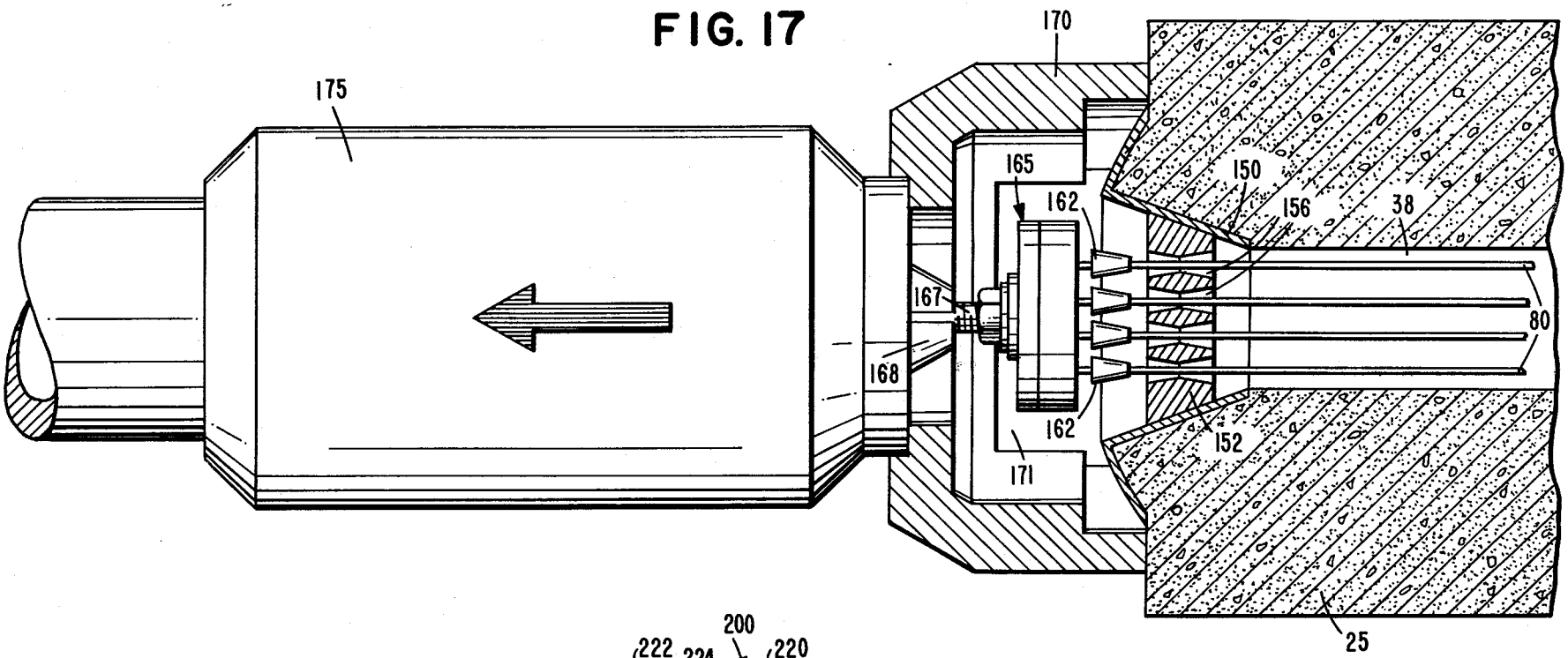
Figure 21:
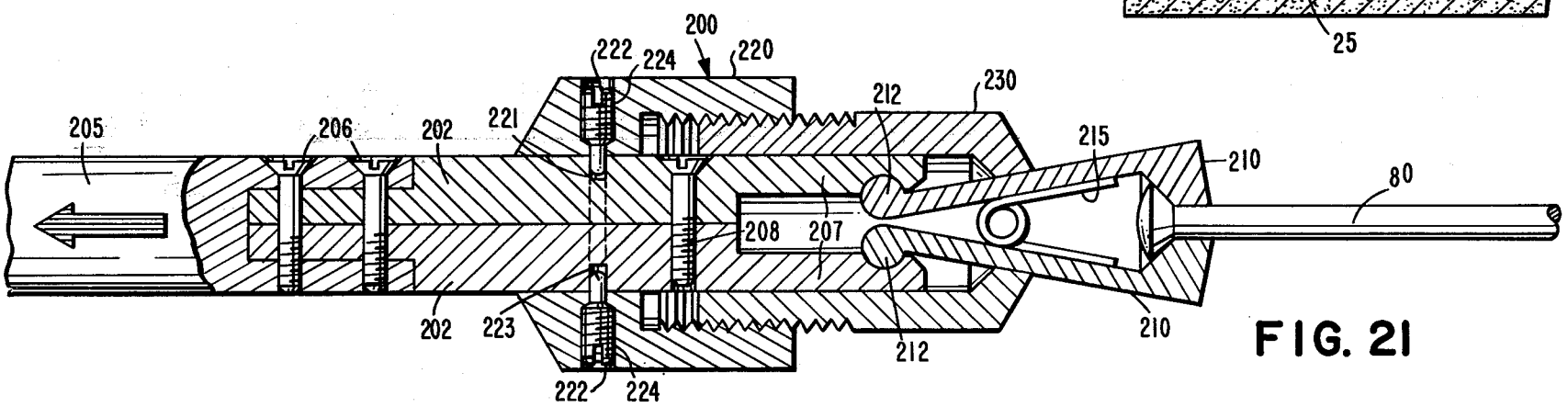
Figure 19:
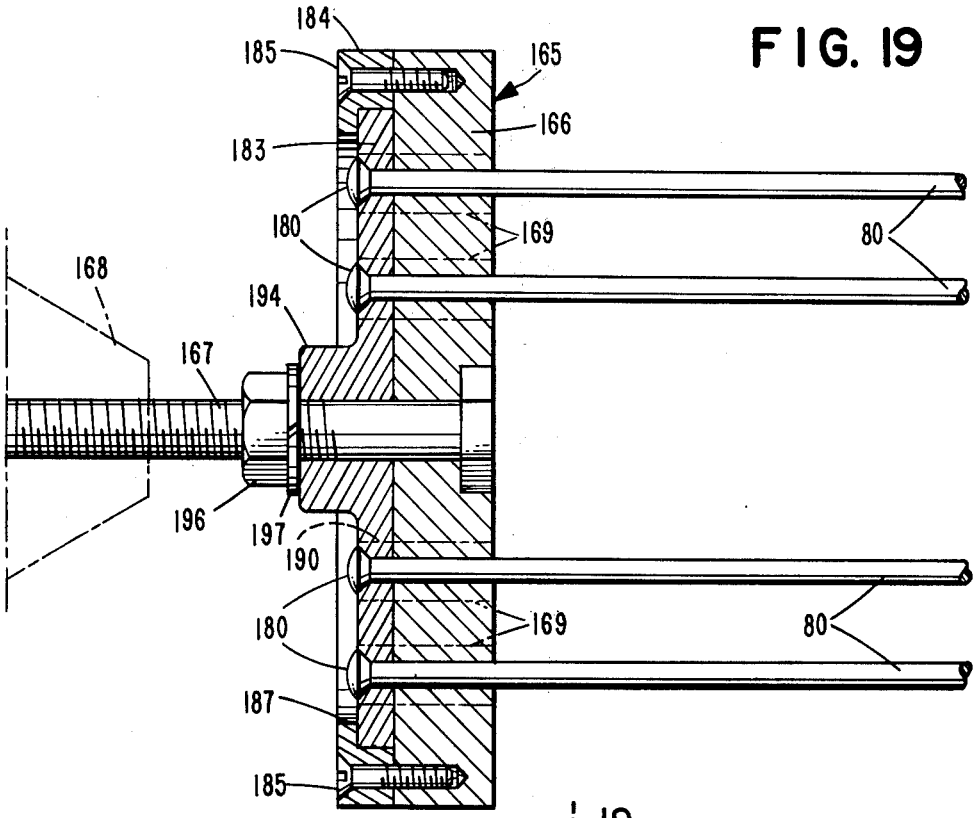
Figure 18:
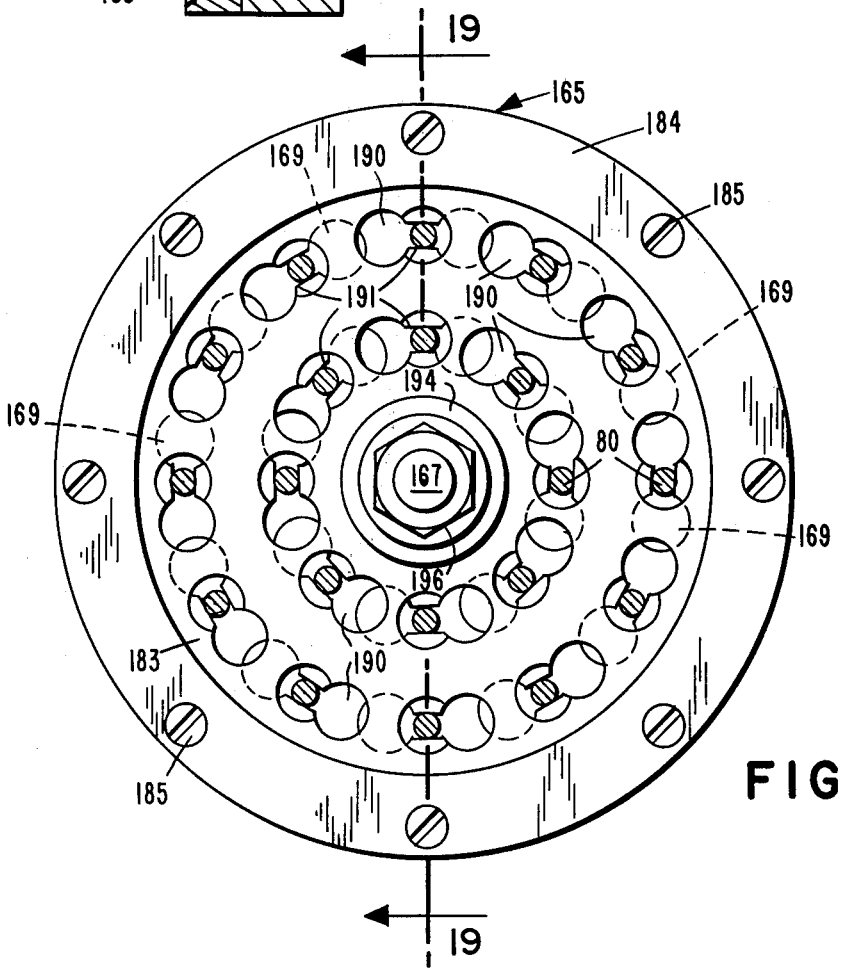
Figure 20:
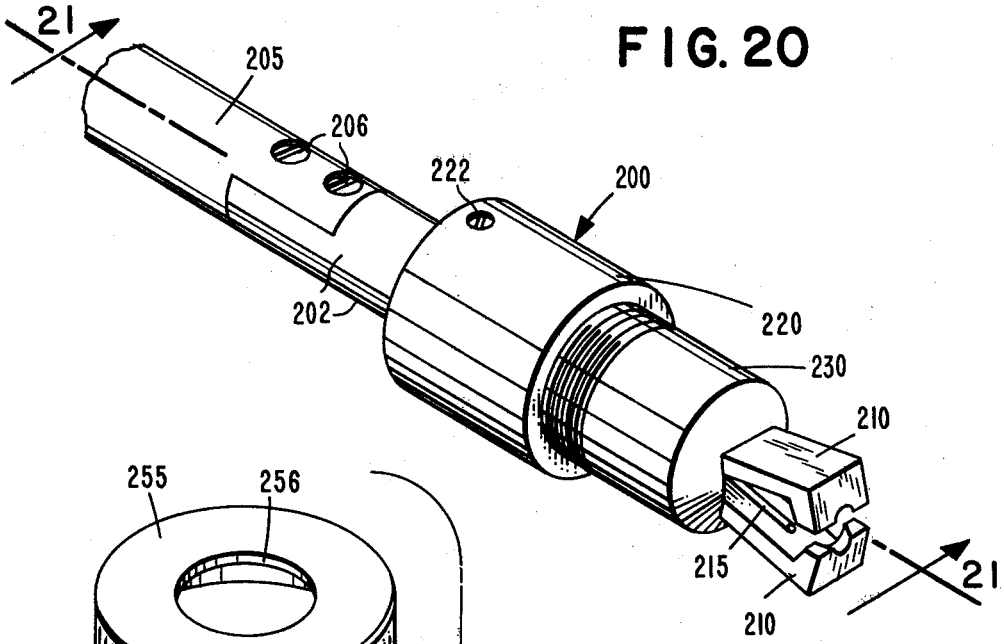
Figure 22:
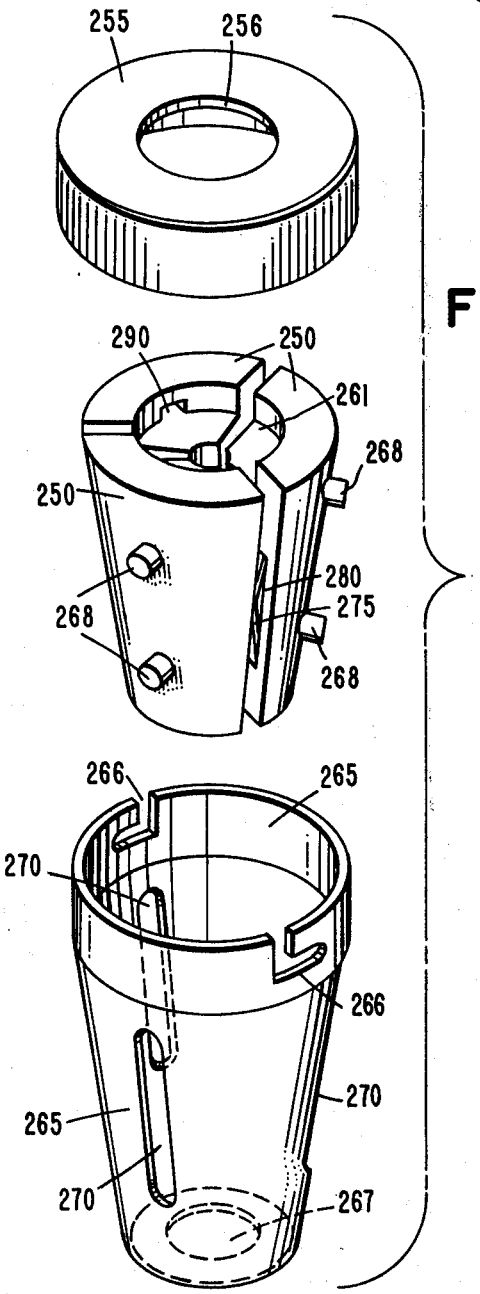
Figure 23:
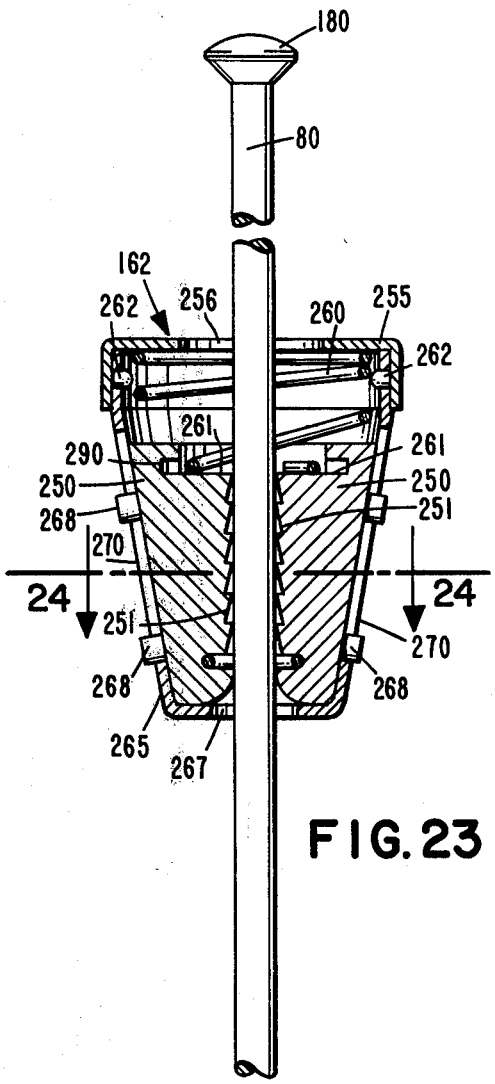
Figure 24:
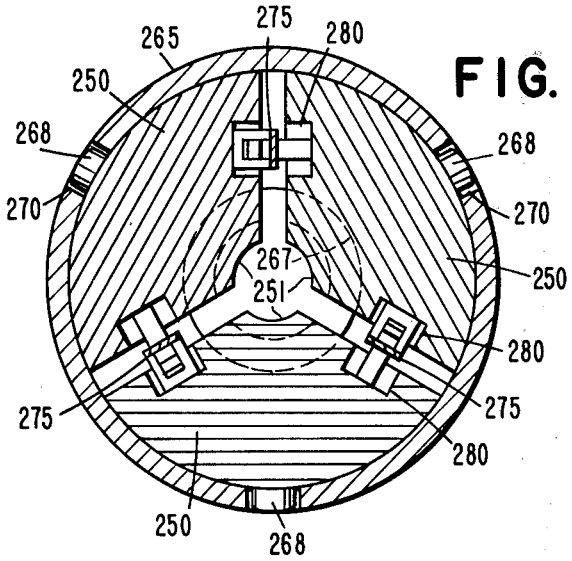
Figure 25:
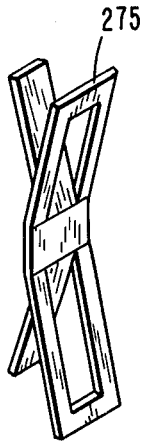
Figure 26:
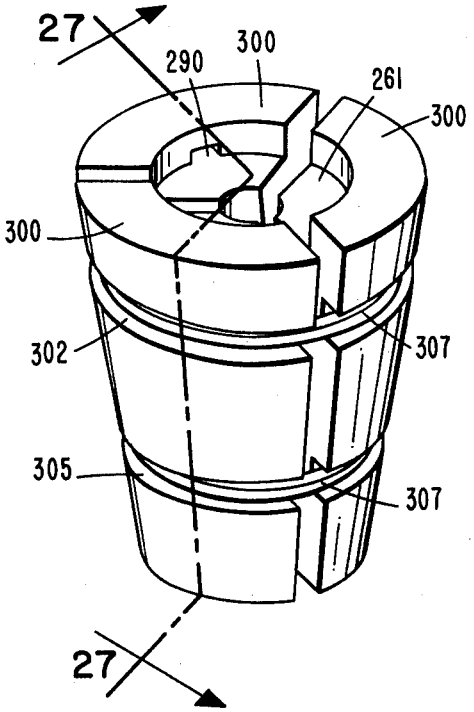
Figure 27:
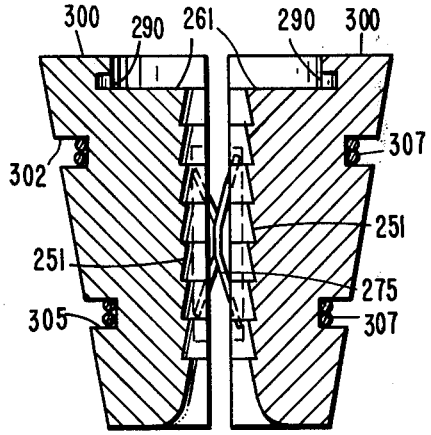

FIG. 14, diagrammatic in nature, is illustrative of a side elevation view of a variation of my invention with the modular structural elements supported in the top portion, for example, as representative of hospital rooms in such portion, with the bottom portion indicating office space, etc., and this Figure thus represents a combination of the figures disclosed in, e.g., FIGS. 4 and 13;

FIGS. 15 and 16 are schematic side elevation views representative of a scheme similar to that shown in FIG. 3 wherein the floor framing portions of a building are individually jacked or elevated one above the other in sequence to attain the entire structure, i.e., such Figures are illustrative of a method of forming a building where the floor elements are assembled on the ground and then jacked or lifted into place;

FIG. 17 is a longitudinal view partially in section of the means for tensioning tendon wires;

FIG. 18 is a plan view of the jacking plate illustrating the keyhole type of securement for the involved tension wires;

FIG. 19 is a section view of the locking mechanism of the jacking plate taken on the line 20—20 of FIG. 19;

FIG. 20 is a perspective view of a single wire tendon clamp used to tension single tendons for typing together a subassembly of structural elements;

FIG. 21 is a section view taken on the line of 21—21 of FIG. 20;

FIG. 22 is an exploded perspective view of the main components of the wedge assembly as same is shown in FIG. 23;

FIG. 23 is a cross-section of the assembly of the elements seen in FIG. 22;

FIG. 24 is a cross-section taken on the line 24—24 of FIG. 23; FIG. 25 is a perspective view of a clip spring used in the wedge assembly and as shown in FIG. 27;

FIG. 26 is a view, in perspective, of an alternate wedge type of assembly for use in the same fashion as the wedge construction illustrated, e.g., in FIG. 23; and FIG. 27 is a section view taken along line 27—27 of FIG. 26.

Figure 1:
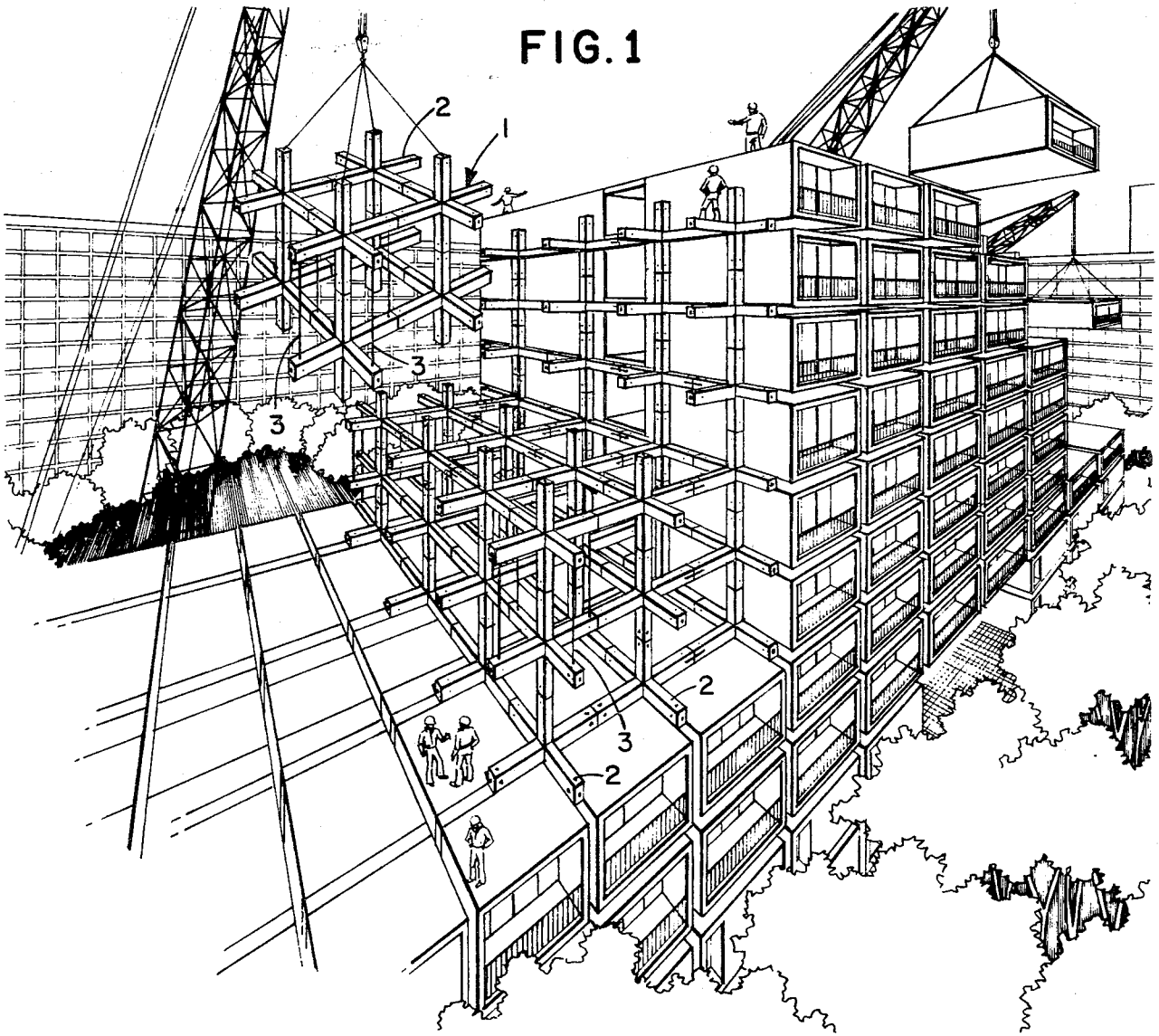
FIG. 1 represents a perspective view of a building under construction using my framing method and showing a subassembly of the basic framing system being swung into place and at the other end of the building a habitable, precast module being inserted into the frame.
Figure 10:
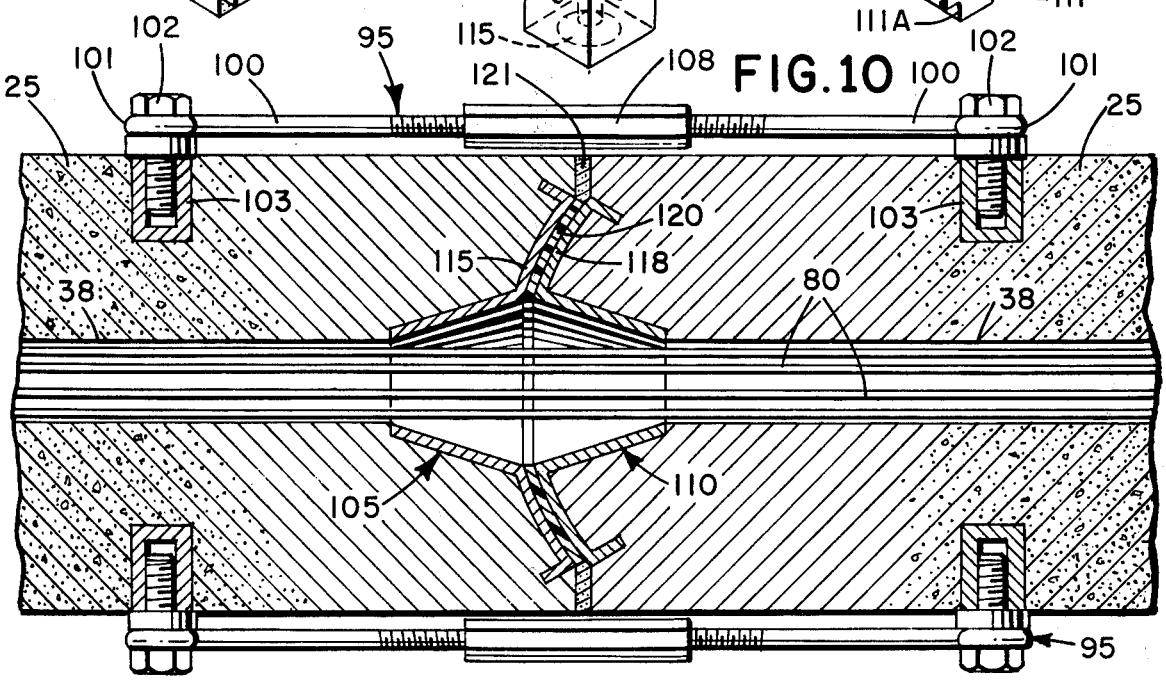
FIG. 10 is a longitudinal section view illustrating the joint between two arms of the structural elements wherein the same are tied together via tension wires used with temporary take-up means to attach such elements together.
Figure 11:
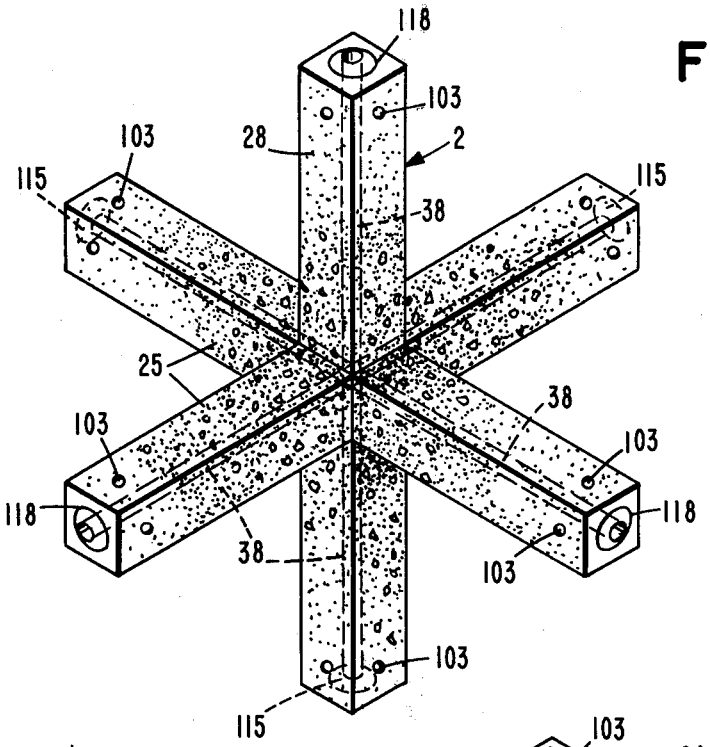
FIGS. 11 and 12 illustrate the basic structural elements utilized in assembling the framing system hereinbefore shown in FIG. 1.
Figure 12:
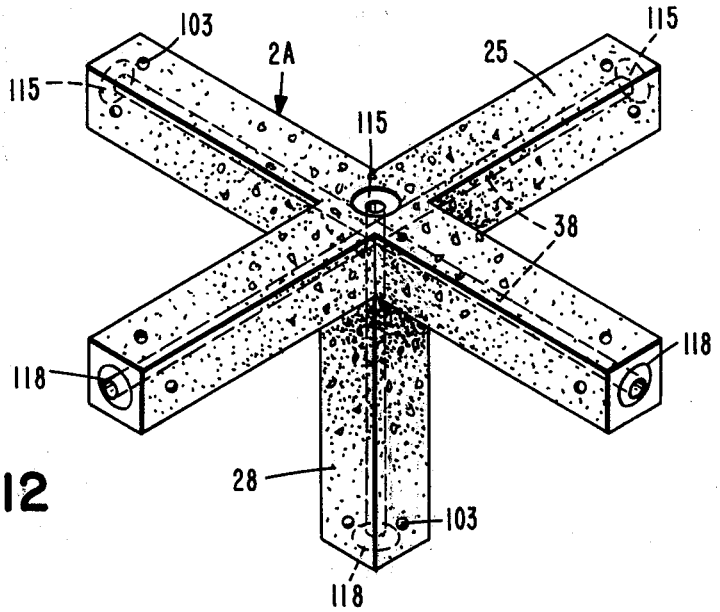

Referring to the foregoing Figures in somewhat more detail, FIG. 1 represents a graphic view of an entire building under construction wherein the basic structural elements, in the form of those depicted in FIGS. 11 and 12 are generally indicated at 1, each of these structural elements denoted at 2. In this graphic view, there are eight of such elements tied together as by tendons passing horizontally and vertically through tendon conduits in the elements and secured at the ends; the alignment of the elements in the subsassembly being accomplished by wire rope or cable ties 3 secured to the horizontal arms of two of the elements in the subassembly as shown, such that the entire assembly of eight can be hoisted and inserted into the appropriate building structure, and prior to tensioning of the entire assembly of these individual elements. When so placed, the subassembly is secured to the inplace framing system by temporary locking means 95 hereinafter shown in more detail in FIG. 10. In FIG. 1 is also represented an entire module representing a room, office or living space, this being hoisted into place into the open space provided by a similar complex eight or more of the elements 2.

Figure 2:
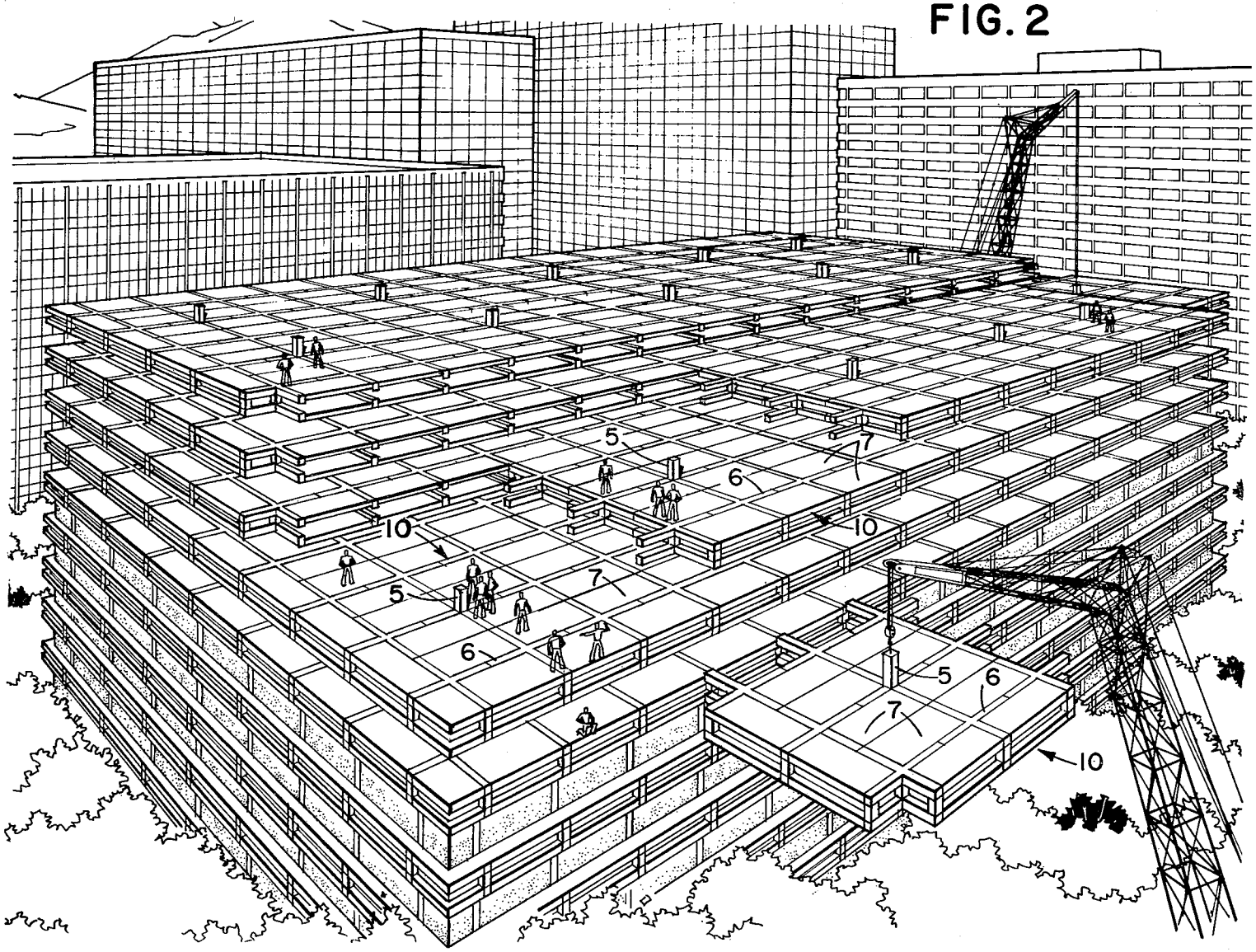
FIG. 2 is a perspective view of an adaptation of my framing method, here utilized to provide a trussed floor or roof framing system. A subassembly of the system is shown being lifted into its place in one of the incomplete floor frames.

FIG. 2, another graphic illustration, shows a subassembly of structural elements 5 and 6 with floor panel inserts 7 which have been secured together and placed under appropriate tension by the means and mechanisms hereinafter related. The entire module 10, in this instance, will be introduced into the incomplete trussed floor framing system and secured thereto by temporary locking means 95 as detailed in FIG. 10, prior to tensioning of the completed assembly. FIG. 13 further illustrates and more particularly describes this system.

FIG. 3 graphically illustrates a tensioned assembly of structural elements 6 with floor panel inserts 7, a mode of building construction wherein, as in the foregoing description thereof, all floors are preassmbled on the ground and sequentially jacked or raised into place about and supported by a series of concrete shafts 18. An individual shaft module 15 is indicated as being placed onto an incomplete shaft assembly 18. As further indicated in FIG. 3, the habitable spaces are generally indicated at 12, whereas the intermediate spacings 11 represent areas for mechanical equipment, such as water and sewage piping, electric and telephone lines, ductwork, etc.

Referring to FIG. 4, each of such structural elements 2 are more particularly identified as comprising a horizontal beam 25 and a vertical column 28. The uppermost of the structural elements, as seen in FIG. 4 does not contain an upper vertical beam 28, this obviously because it is positioned in the top of the building framework. However, the remaining structural elements and as indicated in this figure are all provided with an upper and lower depending column 28. The vertical columns 28 as to each structural element 2 represent half the clear space between floor and ceiling in a typical building and as to the lowermost of this series of vertical columns 28, or those upon which the entire framework is supported, such represent half the distance of the modular space and further represent the mechanical space between the lowermost of the elements 1 and the ground space. In an assembled structure such as shown in FIG. 4, habitable modules are indicated at 30 and as being inserted in this complex of assembled structural elements, again these elements being of the form shown in FIGS. 11 and 12, FIG. 12 representing the uppermost of same and FIG. 11 representing the intermediate elements, all of identical shape, size and configuration.

FIG. 4 is further illustrative of a means to level the entire system, i.e., leveling of the horizontal beams 25 in such manner that there is a continuous leveling of the structure represented thereby. Such leveling devices are also coordinated to coincide with stair and/or elevator shafts, and so on. In the referred to FIG. 4 the here somewhat diagrammatically disclosed leveling may consist of such as a turnbuckle arrangement 32 having at each end thereof wire rope or cable 33 affixed at 36 to the respective adjacent horizontal beams 25. The same means is utilized with regard to the mechanical space, i.e., that between the bottommost floor of the building structure and the footing 49. All of these units 1 or the series of structural elements that are utilized in fabrication of the assembly shown in FIG. 4 are post-tensioned by means of wires placed through the entire adjacent series via conduits or bores 38. This manner of tensioning will be more specifically referred to hereinafter.

The lowermost vertical columns 28 rest upon such as concrete footings 45 and 49, set into the ground, as shown, footing 49 serving as a means of affixing leveling cables 33.

It is, of course, to be understood that all of the elements of the herein involved building structure are of precast concrete including the basic structural elements 1 as well as the modular compartmented units such as graphically indicated at 30 in FIG. 4.

FIG. 5 shows, in addition to the leveling system just referred to with respect to FIG. 4, an alternate form of leveling, both horizontally and vertically, of the assembled structural units 2. Here wall sections such as 55 (as shown in FIG. 5 in cross-section) are inserted on the centerline of each of the adjacent horizontal beams 25 and vertical columns 28. Of course, with such wall sections being configured to an absolute square, insertion of them achieves the result of correspondingly squaring and centering each square configuration formed by, for example, four adjacent and interconnected structural elements 2.

Figure 7:
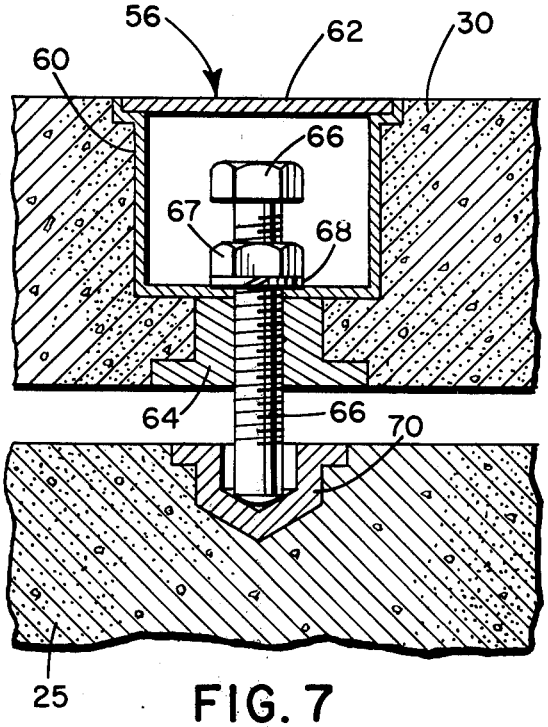
FIG. 7 is a section view taken on the line 7—7 of FIG. 6 and particularly illustrating means for leveling and locking the structure into the provided for space.

Each thusly formed square (or rectangular) space is thus properly positioned for reception of such as a prefabricated or precast concrete module (FIG. 6), the element 2, when aligned and placed under tension, forming a framing system for that module. As shown in FIG. 6 such a precast module 30 is indicated within the space provided by four contiguous arms of each of the structural elements 2, i.e., the interconnected horizontal beams or arms 25 and also the vertical columns 28. Here again some provision must be made for assuring centering of the module 30 itself and this is accomplished by a series of adjustable securing and leveling means, generally indicated at 56. As shown in this FIG. 6, there are, for illustrative purposes, two at the top and two at the bottom, so located as to centrally position the module within the square configuration and adequately space it somewhat from the horizontal and vertical arms of the structural elements, respectively 25 and 28. Each of these adjustable devices 56 is of the same construction, and FIG. 7 illustrates specifically the nature thereof. As shown in this latter figure, the top and bottom panels, or floor and roof of the module 30, are precast with a metal box 60 therein and the latter provided with a removable covering member 62. Such is also precast with an apertured and flanged fitting 64 which is interiorly threaded to receive bolt 66. The amount of extension or retraction of bolt 66 with regard to flange 64 thus can be regulated, and locked into place when its ultimate and desired positioning is reached by lock nut 67, the latter being provided with lock washer 68. The concrete beam 25 is also prefabricated with means to receive the terminal end of bolt 66, and to this end each concrete beam 25 is provided, as shown in FIG. 7, with top and bottom devices adapted to receive the end of the bolt 66 in locked position. Thus this concrete beam is prefabricated with a metal fitting 70 cast into the top and bottom (see FIG. 7). Hence when the module is raised or moved into the position shown in FIG. 6, it is leveled and affixed in position by use of these multiple series of coacting elements, as such have just been described, and as such are illustrated with some particularity in FIG. 7.

Figure 8:
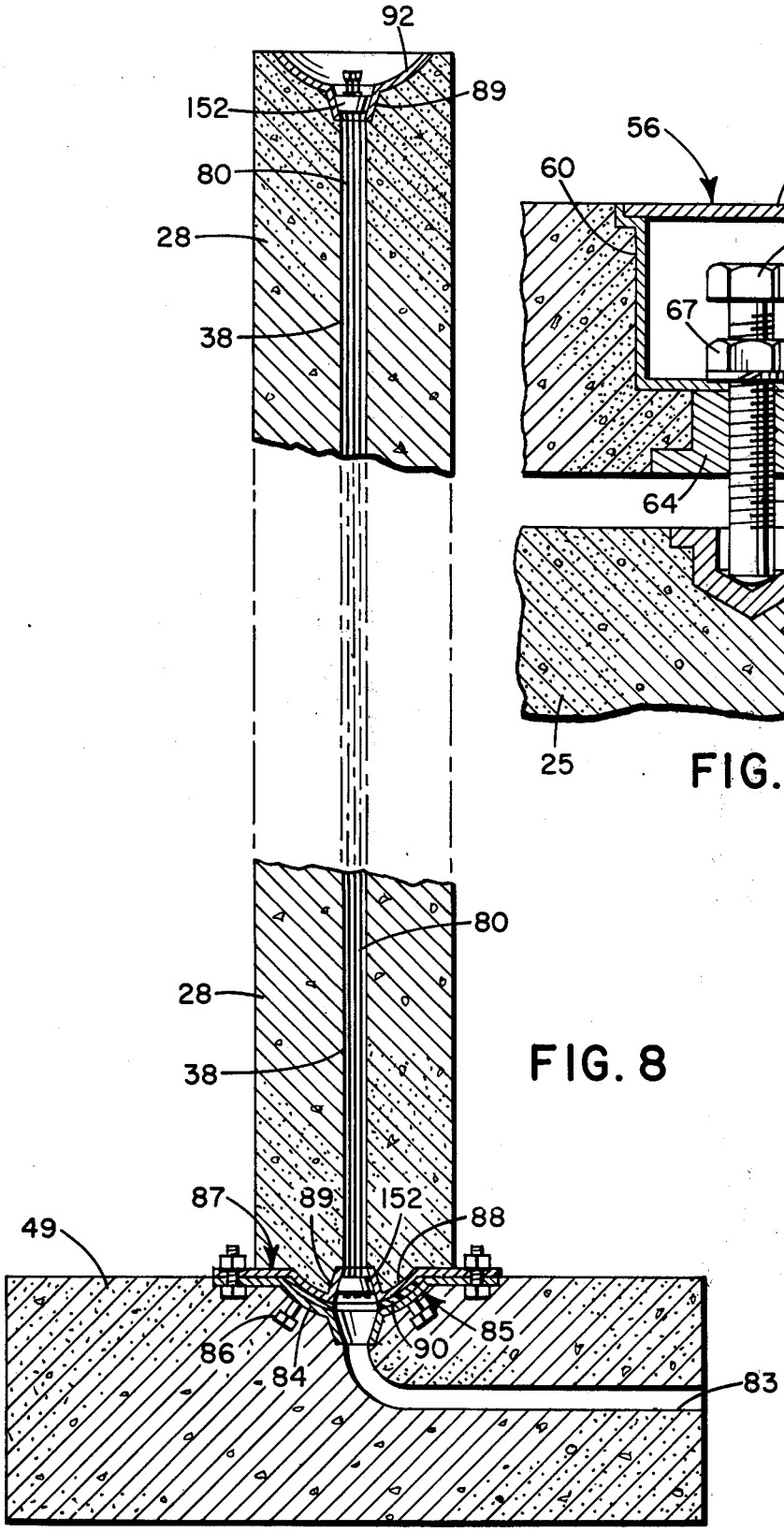
FIG. 8 is a section view taken on the line 8—8 of FIG. 4 illustrating a means of inserting post-tensioning wires in the vertical columns via a horizontal channel formed in the concrete footing upon which such columns rest.

In FIG. 8 is shown a preferred system for the mounting of the bottommost of a column 28 in the usual concrete footing 49 and/or 45, and wherein it is desired to lead the vertical tension wires 80 threaded through conduit 38 and such as column 28 through a horizontal opening or conduit as at 83 in the said footing 49. In other words, once a series of colums 28 in the elements 2 are superimposed one above the other, the tension wires 80 are led through the horizontal bore 83 in the footing and threaded upwardly through the vertical bores 38 in each of such posts. Tension is then applied at the exit of the wires at the topmost of the abutting columns 28. Fixtures, of the type of universal joints, are provided at the bottom of post 28, with regard to footing 49, such that vertical positioning, alignment and securement is assured, and to this end a female cap or fitting 85 is precast into the footing 49 and maintained in secured position as by the embedded elements 86 in the footing. This fixture 85 has a central portion 84, as shown, which is of concave configuration. Surmounted above element 85 is positioned a complementary male cap or fitting 87 having a similarly configured convex surface 88 to match the configuration of the center portion 84 of the element 85. In between the two is superimposed a shim or bearing member 90 of synthetic resinous material such as one made of Teflon or neoprene, i.e., the element 90 representing a bearing gasket therebetween. The male cap 87 is provided with an upstanding flange 89, narrowed at the top, to receive an anchor plug 152, drilled to receive wedges which secure the tension wires 80 in fixed position (see FIG. 17). As shown in FIG. 8, when said wires are threaded firstly through the horizontal bore 83 and thence upwardly through the vertical bore 38 in each of the elements 28, tension is placed upon the opposite or upper end of the wires by a means more fully detailed in FIG. 17, and they are secured at the upper end of columns 28 by wedges inserted into anchor plug 152 which is retained by the referred to conically shaped element 89, again as shown in FIG. 8, thus to maintain the tendon or tendons under tension. In this version of the invention the top of the vertical column 28 is also configured in like manner with a similar type of flange or female fitting 92 adapted to receive a male element similar to that shown at 87; in this way all of the vertical elements 28 can be attached together and then post-tensioned in such manner that the referred to fittings at the point of contact, universal in nature, permit accuracy of vertical alignment.

Figure 9:
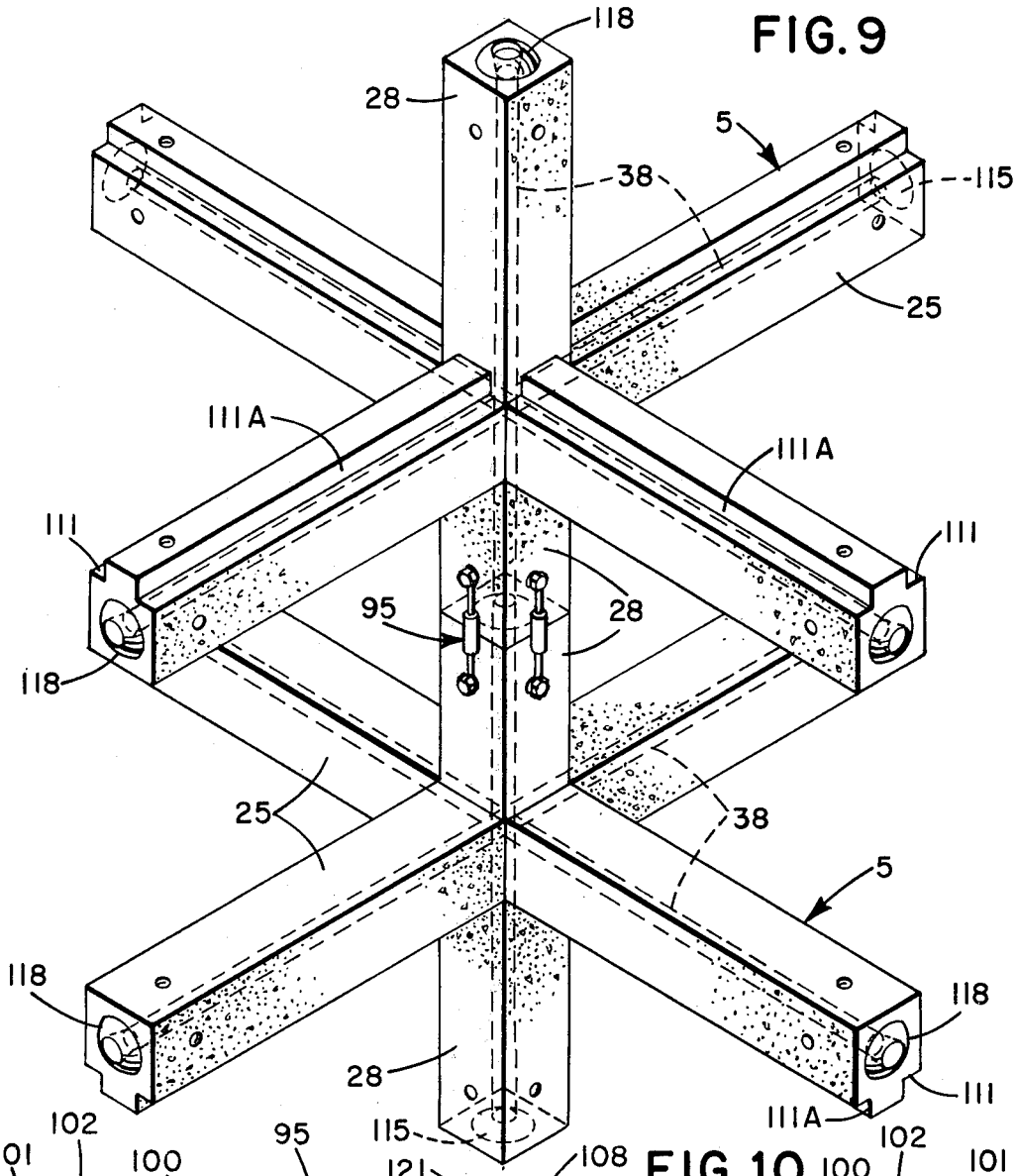
FIG. 9 is a perspective view illustrative of an assembly of two floor framing elements illustrating the bores through the arms thereof adapted to receive post-tensioning wires and further illustrating temporary tie rods utilized for initial subassembly.

In FIG. 9 is shown two of the elements 5, hereinbefore shown in FIG. 2, vertically positioned with regard to each other. Structural element 6, also shown in FIG. 2, is similar to element 5 with the exception of the absence of upstanding column element 28; its configuration is similar to that element shown in FIG. 12. The horizontal arms 25 of these structural elements 5 and 6 are provided with recesses 111 and 111A to accommodate placement of cast floor and/or ceiling panels 7, as illustrated in FIG. 2, said panels being secured to the structural elements by an appropriate means not here shown. Prior to post-tensioning, these two elements 5 are secured together by temporary locking means in the form of a turnbuckle arrangement generally indicated at 95 (FIG. 9). This latter is shown in more detail in FIG. 10. The representation in FIG. 10 is somewhat similar to that of the FIG. 8 connecting means relating to the positioning with respect to the bottommost vertical column to the footing 49. In this regard, here again, there is provided in each of the columns 28 or side arms 25 a universal joint type of arrangement represented by a female fitting 105 having a circular flange 115 that is concave in configuration. This is matched by an opposing male fitting 110 in the adjacent element 25 or 28. Similarly, each of the fittings 110 terminate in a circular flange 118, convex in configuration to match the flange 115 in the facing post or arm. Also, a synthetic resinous gasket or washer 120 is disposed in between each of the flanges 115 and 118, the member 120 providing a full bearing surface. A fireproof insulating material 121 is inserted in between the ends of adjacent arms 25.

The referred to turnbuckle arrangement, 95, is more particularly shown in FIG. 10. Here elements 100 are provided with a thread at their interior ends and eye-configuration 101 at their outer ends. Suitable bolts 102 are inserted through each of the eyes 101 and threaded into a fitting 103 which has been precast into all of the horizontal and vertical arms 25 and 28 respectively. A double threaded element 108, in the nature of a turnbuckle, engages the threads at the ends of the elements 100 such that when positioned as shown in FIGS. 9 and 10, rotation of the turnbuckle 108 will cause the two opposing members 100 to be forced together thus locking each of the columns or elements 25 and 28 into fixed position. As shown in FIG. 10 the tension wires 80 are threaded through the bores 38 with tension being applied after the basic structural elements have been positioned and secured in place prior to tensioning by such as means 95 above referred to.

The structural elements 2 and 2A, as such are shown in FIGS. 11 and 12, form the basic structural members comprising the framework of the building illustrated in FIG. 1 and further described in FIG. 4. The elements as illustrated contain tendon bores 38, flanges 115 and 118, and fittings 103 as hereinbefore described with respect to FIGS. 9 and 10.

FIG. 13 is a diagrammatic vertical cross-section of the trussed floor framing system illustrated in FIG. 2 and hereinbefore described. Here it can be seen that structural elements 5, illustrated in FIG. 9, are utilized to form the columns 125 in the building structure and the trussed framework between these columns is made up of structural elements 6, which are cantilevered at C. The leveling and alignment of the framing is accomplished by wire rope 33 and turnbuckle 32 means previously illustrated in FIG. 4 and hereinbefore described. The construction here is such that a shallower area, generally designated at A, comprises the space for installation of the mechanical fixtures necessary in any given and completed building units, such as spaces for ductwork, wiring, water and sewage lines, etc. On the other hand, the spaces of larger vertical height, such as generally indicated at B, represent habitable or occupied spaces such as office rooms and suites. With regard to these spaces A and B, the basic structural elements 5 and 6 are utilized, again comprising such as that depicted in FIG. 12 where the vertical arms 28, however, are of shorter length as to the mechanical spaces A, such arms being indicated at 130. When a unit of this type, with such shorter arms is employed in the main supporting columns 125, then as will be seen from FIG. 13 the upper vertical post 28 of each structural element 5 is substantially longer than the shorter vertical leg 130. Thus these longer vertical shafts will provide for greater vertical height in the spaces B. In a practical adaptation of such elements to the structure as indicated in FIG. 13 wherein a series of structural elements 6 are positioned within the boundaries of the two vertical posts 125, the distance between such structural elements with regard to area B is preferably about 8 feet, whereas with respect to the mechanical space A the height thereof would be in the order of 4 to 6 feet. Each of the columns 125 are of course located at their lower ends in a concrete footing 135 from which extends a vertical stanchion or post 138.

FIG. 14 represents another diagrammatic configuration of the possible use of the same structural elements 2, 5 and 6 (as shown in FIGS. 9, 11 and 12). Here is depicted in graphic form the use of such structural elements in such as a hospital wherein the upper portion thereof is fitted with modules 140, representing prefabricated, i.e., precast concrete, modules adapted for use as rooms for patients. Underneath that upper framework is again found utilization of the trussed floor framing system with cantilevers at (C) as it is shown in FIG. 13 with mechanical spaces A and larger areas B for office and related facilities.

The adaptability of this same structural system is represented in FIGS. 15 and 16. These graphically depict a system wherein the basic structural framework, again made of the assemblies of the basic formations 6, is constructed upon the ground and then jacked upwardly to complete the entire building assembly. In FIG. 15, two utility shafts 141 are first erected. Here is shown a series of trussed floor framing systems **10*a* to 10*f*, inclusive, all prefabricated of the same structural elements 6, and erected on the ground with such as the shaft 141 as centering locations and guide posts for erection of each of these sections upwardly. In FIG. 16 each of these individual floor framing systems 10*a* to 10*e* inclusive has been successively jacked upwardly about the shafts 141 leaving desired spaces therebetween, as graphically illustrated, for offices and/or related facilities. In the sequence of operation, the structure 10*a* would be first into the position shown in FIG. 16. The combined structure 10*b* then being jacked an equal amount upwardly, with this same sequence following through all of the structures therein illustrated, i.e., from 10*c* to 10*f***, inclusive.

FIGS. 17, 18 and 19 are illustrative of a means and method for tensioning a plurality of tendons, and are illustrative of the components utilized for this purpose.

Referring to FIG. 17, four tendons 80 are shown passing through the tendon conduit or bore 38 formed in such as the precast concrete element 28. A fitting 150 is placed in the end of this horizontal leg 28 of the basic structural element in the framing system. This fitting 150 is, as indicated, of conical configuration and is cast into the end of the structural element 28. This fitting 150 is adapted to receive an anchor plug 152, circular in configuration and having its periphery angled to conform to the angle or configuration of the element 150, as illustrated in FIG. 17. There are a series of apertures or holes 156 through this anchor plug 152, these being of a shape as shown in FIG. 17, i.e., decreasing in diameter from the outer edges thereof toward the center of the anchor plug 152. After the tendons are passed through these openings 156, individual wedges 162 are placed over each of such tendons 80, the purpose of these wedges being to seat within the several openings 156 and thus retain the tendons under strain or in a position of tension after tension has been applied to them in a manner to be described.

The tendons are secured in a jacking plate assembly 165 and the latter, through a threaded element 167, is attached to an hydraulic jack 175 via any suitable interconnecting means 168. The hydraulic jack rests upon a jack stool 170 which at one end bears against the hydraulic jack itself and at the other end is seated against the outer face or end of the concrete structural element 28. This jack stool is provided with spaces between the legs thereof such as indicated at 171 so that in the position of the arrangement just described a suitable tool can be inserted in between the jack stool and behind each of the wedges to force the wedges into the opening or tapered holes 156 after the tendons have been tensioned the desired amount. After such operation of tensioning the hydraulic jack 175, jack stool 170 and the jacking plate assembly, generally indicated at 165, are removed.

FIG. 19 is illustrative of further details of the jacking plate assembly 165. Here the jacking plate 166 is provided with a series of apertures 169 of sufficient size to permit passage therethrough of the tendon buttons or enlargements 180 formed upon the ends of each of the tendons. A rotatable locking plate 183 is provided, this plate rotating about the shaft of the member 167. It is secured in place by a retaining ring 184, the latter being secured to the jacking plate 166 by such suitable means as screw elements 185. The retaining ring 184 is provided with an inwardly extending circular flange 187 such that the locking plate 183 is permitted to rotate between said flange 187 and the surface of the jacking plate 165. The center of the retaining ring is provided with an enlarged bushing or bearing element 194 secured is placed by threaded nut 196 and intermediate lock washer 197.

With further reference to the rotatable locking plate 183, same is provided with a series of keyhole shaped slots of a number the same as the number of like keyhole shaped slots in the jacking plate 166. Viewing FIG. 18, it is seen that these keyhole slots are formed by a larger opening 190 which is sufficient to permit passage of the tendon buttons 180 therethrough. These openings 190 terminate or extend into a slot formation 191 of smaller diameter, the latter being of a size to receive, with a rather close tolerance, the tendons 80. In the position shown in FIG. 18, the ends of each tendon have been passed through the bores 169 in the jacking plate, through the larger opening 190 of the keyhole configuration and then the locking plate turned to the left (as seen in this figure) via the bushing 194, thus to lock the tendons in the position shown before tension is applied to each through the assembly just described and via use of the hydraulic jack 175. The details of the latter are not shown; however, this type of jack equipment is well known to the art and suitable for the purposes of tensioning the tendons as this operation has hereinbefore been described.

It should be noted that the referred to central hub portion 194 of the locking plate is enlarged such that with use of suitable tooling the locking plate can be turned in either direction (upon back off of the nut 196) so that the tendons can be held as shown in FIG. 18 while under stress, but alternatively, if removal thereof is desired, the rotatable locking plate can be turned to the right (as shown in FIG. 18) thus to position the openings 190 over the tendon buttons, permitting removal of the tendons from the jacking plate assembly.

Under certain circumstances, it may be desirable to use a device adapted to tension only a single tendon, and particularly where the latter is utilized in tying together the referred to basic structural elements 2 of a subassembly. Such a device is illustrated in FIGS. 20 and 21. Referring particularly to FIG. 21 representing a cross-section of such single tendon clamp, generally indicated at 200, it is seen that a two-part element 202, each half of which is semi-cylindrical, is pinned together and secured to a rod 205 by means of such as screw elements 206. The two members 202 terminate at the opposite end in extensions 207 of smaller cross-section. The spaced extensions 207 are provided with recesses therein to receive the ball-like elements 212 forming the terminal ends of two jaws 210. These two jaws 210 are constantly urged outwardly by a spring 215 but adapted to firmly grasp the button or enlarged end portion 180 of a single tendon 80. An externally threaded collar 230 surrounds the two elements 207 as shown in FIG. 21 and this collar is further encompassed by an internally threaded rotatable element 220 provided with threads to match the threads upon the collar 230. The two elements 202 are further held together by the threaded member 208. It is obvious that when the rotatable element 220 is rotated it moves the threaded member or collar 230 either towards or away from the ends of the jaws 210 thus tightening or releasing their hold on the tendon 80. The two semi-cylindrical elements or retainers 202 are provided with a groove as shown at 221, for the purpose of accepting threaded elements or set screws 222, each of which are provided with an extension 223 adapted to penetrate the circumferential groove 221. In the position shown in FIG. 21, these set screws 222 have been threaded into the appropriately threaded bores 224 a sufficient amount to lock the member 220 and two members 202 in longitudinal alignment. As illustrated, the tension rod 80 is shown as being tightly gripped with the button or enlarged end thereof 180 fitting within the jaws 210, the latter being provided with a beveled surface which is complementary to the interior angle of said button 180. The rod 205 to which this assembly is attached is provided with an appropriate coupling (not shown) that would enable it to be secured to an appropriate jacking device or hydraulic jack similar to that or at least performing the same function as the hydraulic jack 175 shown in FIG. 17.

FIGS. 22 to 25 inclusive are illustrative of one version of a type of wedge assembly utilized as such wedges are depicted at 162 in FIG. 17, the wedges of course being adapted to be inserted into the anchor plug 152 for the purpose of securing the tendons therein after tension has been applied to each of the tendons 80.

Referring to these figures in more detail, it is seen that each wedge comprises separate wedge components 250 and of the configuration as shown, e.g., FIG. 22. Each of these wedges is adapted to be inserted into a wedge retaining cut 265 the interior of which matches the exterior configuration of the several wedges 250. A spring retaining cap 255 is used to retain a spring 260 which bears against the inner surface of the cap at one end and upon appropriate depressions 161 formed in each of the wedges 250. Each of the wedge configurations 250 is provided with serrated interior edges or faces 251 for the purpose of grasping each tendon 80 after tension has been applied. The cap 255 is provided with two or more interiorly extending studs 262 which are adapted to fit within appropriate groove-slot locking configurations 266 formed within the upper portion of the retaining cup 265. Each of the wedges is also provided with (as here shown) two aligning studs 268 and these fit into stud key ways 270 formed in the side of the retaining cup 265. The retaining cap 255 is provided with an aperture 256 of sufficient diameter to permit passage therethrough of the tendon and tendon button 180 and similarly, the retaining cup 265, at its lower end, is provided with an aperture 267 of sufficient diameter to also permit passage of the tendon and tendon button 180 therethrough. Three clip or separator springs 275, made of spring steel or like material, and having the general configuration as shown in FIG. 25, are positioned in between each of the wedges 250 within appropriate groove 280 in the side of each wedge. Such springs tend to force the wedges outwardly against the inner surface of the retaining cup 265.

Before tensioning is performed in the manner as shown in FIG. 17, this type wedge assembly (there indicated at 162) is slid onto each of the tendons 80, the separate wedges 250 sliding up the cup 265 to permit the passage therethrough of the enlarged tendon button 180. When the tendons are all simultaneously tensioned as shown in the operations depicted in FIG. 17, such wedge assemblies can be tapped by a suitable tool into the wire holes 156 of the anchor plug 152. As tension is released on the tendons 80, they are secured in place by the serrated edges 251 of each of wedged elements 250 which comprise the individual wedge formation. To remove these wedges which are set into the anchor plug 152 and thus free the tendons to permit disassembly of a given structural system, it is only necessary to retension the tendons 80. When this is done, the wedges 162 are freed from the wire holes 156 (FIG. 17) and may be slid up the tendons 80 prior to releasing the latter from the jacking plate assembly 165. To facilitate removal of these wedge assemblies 162, recesses 290 are provided in each of the elements 250 (see FIG. 22). These recesses 290 are provided to accommodate a wedge assembly exterior tool (not shown) enabling extraction thereof.

A simpler and alternate form of wedge assembly is illustrated in FIGS. 26 and 27. Here again three separate wedge elements 300 are utilized, these being of the same conical configuration as shown in FIG. 22. Each is of course provided with the same interior serrated edges 251, such that again upon tensioning of the tendons 80 and with the wedge assembly forced into the openings 156 of the anchor plug 152, the several tendons are maintained securely under tension. In this simpler version of the wedge assembly, two upper and lower grooves 302 and 305 are formed in each of the separate wedge elements 300. The latter elements are forced together by circular springs 307 which serve to hold the several elements 300 in alignment. Also, the same type of wedge separator springs 275, as used in connection with the wedge assembly of FIG. 22, are again employed to further assist in the proper alignment and positioning of the several wedges 300. This wedge assembly as just described and as depicted in FIGS. 26 and 27 is utilized in a similar manner to those wedges of FIGS. 22 to 24 inclusive; in each instance, the rods are tensioned in the manner hereinbefore described, then the wedges after tensioning forced into the several openings 156 in the anchor plug 152. Upon disassembly, tension is applied and the wedges removed in the manner hereinbefore described.

From the foregoing description of my invention, it should be apparent that I have devised a building system wherein a primary advantage resides in the use of a plurality of structural elements which are representative of extreme simplicity, yet such elements permit the construction or erection of a building of almost any lateral and vertical dimension. These basic structural elements are precast and the tensioning system employed therewith, when they are used in multiples, permits complete control of deflections under all conditions for all types of assemblies including cantilevers — the tensioning of the tendons through the appropriate conduits of each structural element, abutting similar elements, accomplishing the basic requirements of rigidity and strength. What is further considered to be a concept completely novel to the prior art is the fact that in the instant development, still utilizing the same basic structural elements, additions can be easily made to structures already completed; and conversely, completed structural can be reduced in size by simply removal of the beam and post subassemblies which are utilized in the formation of the structures.

While particular embodiments and features of this invention have been illustrated and described in the foregoing, it is not intended to limit the same to all of the constructional details above set forth, the intention being that this invention embraces such alterations or equivalents as fall within the scope of the claims appended hereto.

I claim:

1. In a building system wherein an assembly of post-tensioned structural elements are utilized, said post-tensioning being accomplished after preliminary assembly of said structural elements, the combination comprising:

a. a multiple number of said structural elements, each of said elements being of precast material and comprising at least four intersecting legs extending from a common axis and lying in one plane and at least one leg extending from said axis and in a second plane vertically to said one plane, each of said legs having a tendon conduit therethrough, said conduit being adapted to receive a plurality of tendons therethrough, said structural elements being aligned so that the legs in one plane abut each other and the legs in said second plane abut each other thereby to permit alignment of the conduits in said respective one and second planes;

b. a plurality of tendons extending through said conduits in said one and second planes, each of said tendons having a button at the end thereof, c. means to lock said tendons in position before tension has been applied thereto comprising a rotatable locking plate having a plurality of keyhole tendon and tendon button receiving apertures therein, whereby, upon rotation in one direction said tendon buttons are retained by said plate to maintain tension and upon rotation in the opposite direction said tendon buttons are released to thereby release said tension, d. means to exert tension upon the ends of said tendons at the outermost of said legs, said means including an anchor plug in the end of each of said outermost legs, said anchor plug having apertures therein to receive said tendons, wedges adapted to engage said tendons and be retained in said apertures after tension has been applied to said tendons, and e. tension applying means in interconnection with the ends of said tendons.

2. The invention as defined in claim 1 wherein said wedges comprise at least three separate members which when positioned together form a conical configuration, a retaining cup surrounding said members, a spring means to urge said members outwardly within said retaining cup, interior serrated edges on each of said members, said edges being adapted to maintain said tendons under tension after tension is applied thereto, and said members being separated sufficiently within said retaining cup to permit passage therethrough of said tendons prior to application of tension thereto.

3. The invention as defined in claim 1 wherein the bottommost of said legs in said second plane are positioned upon a precast base element having a positioning means thereon, said element having an horizontal conduit therethrough interconnected with the conduit in said bottommost of said legs, whereby said tendons may be fed through said horizontal conduit, through said conduit in said bottommost leg and through the conduits of surmounting and abutting legs positioned in said second plane.

4. The invention as defined in claim 3 wherein said positioning means comprises a universal joint at the juncture of the connected, structural elements permitting adjustment and vertical alignment of all of said structural elements.

5. The invention as defined in claim 1 wherein said structural elements when tensioned together by said tendons form at least one open area surrounded by said legs of said structural elements, a precast living area module positioned in said area and means to vertically and horizontally align said module within said area, said alignment means comprising a plurality of bolt-receiving means cast into said module, and adjustable bolt means in said legs opposite said bolt-receiving means, whereby ajustment of said bolt means enables vertical and horizontal alignment of said module with respect to said area.

* * * * *